United States Patent [19]

Yoshida et al.

[11] Patent Number: 4,630,222

[45] Date of Patent: Dec. 16, 1986

[54] ONE CHIP INTEGRATED CIRCUIT FOR ELECTRONIC APPARATUS WITH MEANS FOR GENERATING SOUND MESSAGES

[75] Inventors: Hideo Yoshida, Kashihara; Hisao Kunita, Yamatokoriyama, both of Japan

[73] Assignee: Sharp Kabushiki Kaisha, Osaka, Japan

[21] Appl. No.: 435,254

[22] Filed: Oct. 19, 1982

[30] Foreign Application Priority Data

Oct. 22, 1981 [JP] Japan ..... 56-169750

[51] Int. Cl.[4] ..... G10L 5/00

[52] U.S. Cl. ..... 364/513.5; 381/51

[58] Field of Search ..... 381/51-53; 368/63

[56] References Cited

U.S. PATENT DOCUMENTS

| | | | |
|---|---|---|---|
| 3,775,756 | 11/1973 | Balser | 364/200 |
| 4,369,334 | 1/1983 | Nakatani et al. | 381/51 |
| 4,387,269 | 6/1983 | Hashimoto et al. . | |
| 4,421,416 | 12/1983 | Hashimoto et al. | 381/51 |
| 4,423,290 | 12/1983 | Yoshida et al. . | |
| 4,429,182 | 1/1984 | Masuzawa et al. . | |
| 4,429,367 | 1/1984 | Ikeda . | |
| 4,441,399 | 4/1984 | Wiggins et al. . | |

*Primary Examiner*—E. S. Matt Kemeny

*Attorney, Agent, or Firm*—Birch, Stewart, Kolasch & Birch

[57] ABSTRACT

A calculator system with visual and speech outputs uses a single monolithic LSI chip which includes: a single ROM containing program instructions for both system and speech control, as well as data for synthesizing speech; a central controller which calculates both inputted data and program execution data to control the system, and a RAM used by the central controller in manipulating data.

4 Claims, 9 Drawing Figures

ONE CHIP INTEGRATED CIRCUIT FOR ELECTRONIC APPARATUS WITH MEANS FOR GENERATING SOUND MESSAGES

BACKGROUND OF THE PRESENT INVENTION

The present invention relates to an integrated circuit for generation of sound by means of an electronic apparatus, and in particular to a large scale integrated circuit (LSI) for an electronic apparatus by which the input and output of sound may be obtained synthetic speech generated, and which also includes key input/output apparatus and display apparatus.

In recent years, television games in which the sound of cannons is heard, electronic calculators and timepieces which play melodies, pocket learning devices and electronic calculators which emit human voices, automatic vending machines, and other types of electronic apparatus which emit sounds have made their appearances one after the other. These types of products have been, in part, responsible for the development of LSI technology and in the furthering of synthetic speech generation techniques.

A synthetic speech apparatus used in electronic equipment for sound generation is basically of the type shown in FIG. 1, which is comprised of a ROM 1, in which voice data is stored, and a speech synthesizing circuit 2 which synthesizes a voice signal from this data, with a control circuit 3 which controls the starting and stopping of the synthesizing procedure and the readout from ROM 1. The speech synthesizing circuit 2, from a general point of view, is usually made up of a special synthetic speech LSI, which is used as one of the parts of the speech synthesizing section of this synthetic speech apparatus. Therefore, in the case where this LSI comprises, for example, an element of an electronic calculator which converts calculated formulas, and results, into information in the form of speech (FIG. 2), a microprocessor 4 generally controls the primary key input, the operation, and the display, and this microprocessor develops information in the form of speech from the instruction signal to be provided a specialized speech synthesizing LSI 2.

However, considering the scale of apparatus involved in speech generating electronic calculators and timepieces from the aspect of the configuration of the whole system, the circuit includes a relatively large device portion devoted to speech synthesis as compared with the primary function control circuit. There is considerable demand for a miniaturized compact unit, such as a speech generating electronic calculator which is small enough to be held in the palm of the hand.

OBJECT AND SUMMARY OF THE INVENTION

With the foregoing in mind, the object of the present invention is to provide an integrated circuit of compact configuration to be used in a sound generating electronic apparatus, said integrated circuit to be comprised of one chip containing the complete functions of key input control, operation control, and display control.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

The integrated circuit, according to the present invention, contains on one chip, at least, a ROM containing the previously stored control program (main program) of the main body of the apparatus, voice data for preparing synthesized speech, and control instructions for preparing synthesized speech from the said voice data; and a RAM having at least the storage area used in the execution of the control program for the main apparatus, and the storage area used in the execution of the control program for preparing synthesized speech; and means for operating input control to control the input signal from the operating input means for the keys connected externally, etc.; and the means for controlling the display which is displayed externally; and the means for controlling the calculations for processing the input data and the voice data.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
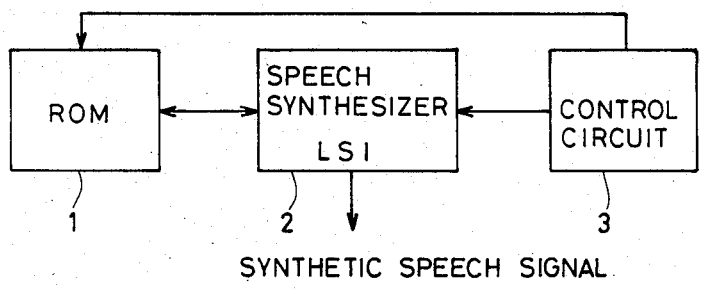
FIG.1 PRIOR ART
FIG. 1 is a block diagram showing the basic configuration of the voice synthesizing apparatus.
Figure 2:
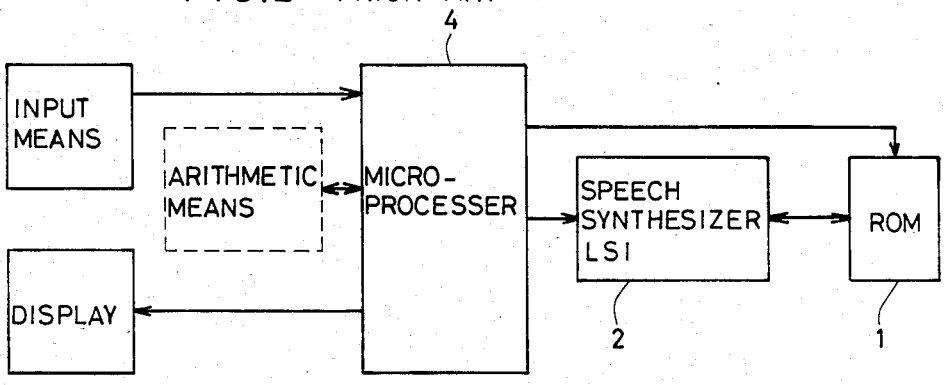
FIG.2 PRIOR ART
FIG. 2 is a block diagram showing the configuration of conventional sound generating electronic apparatus.
Figure 3:
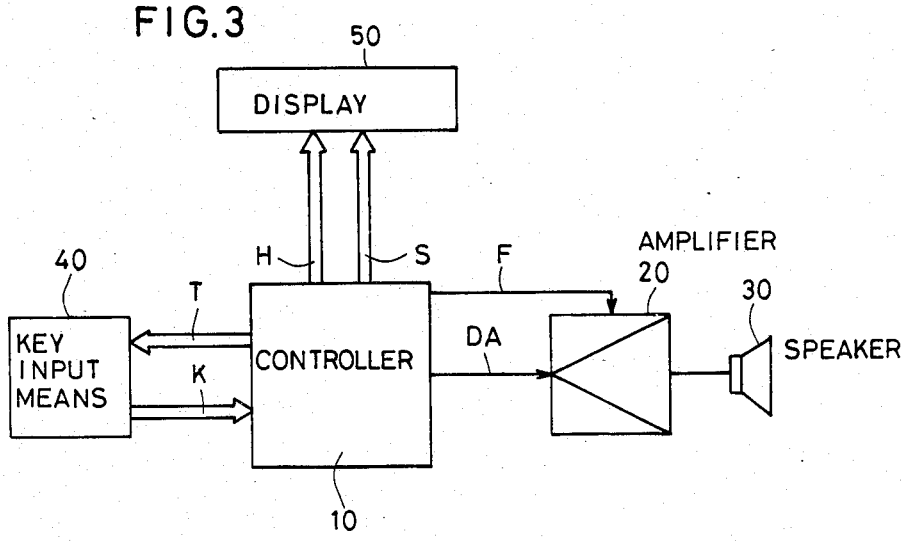
FIG. 3 is a block diagram showing the configuration of an application of one embodiment of the present invention in a voice generating electronic calculator.

First we will explain FIG. 3 which is a block diagram showing a voice synthesizing electronic calculator containing one embodiment of the present invention. In this diagram there is a controller 10 which is comprised of a one chip LSI which controls voice synthesizing and other actions, and is furnished with several types of external terminals. A voice signal output line DA is connected to a voice signal amplifier apparatus 20. A speaker 30 is connected to this output line amplifier 20. Also, a signal F1 controls the power supply of the amplifier apparatus 20, and is taken off the #1 terminal of the output port of the controller 10. A stop signal output line T, and a key return signal line K, are connected to a key output apparatus 40, which is the operating output means. A common signal line H, and a segment signal line S are connected to a display means, such as a liquid crystal display apparatus 50. In the controller 10, there is a built-in Read Only Memory (ROM) containing previously stored voice data and voice synthesizing apparatus programs and a main program which operates an electronic calculator, a built-in Random Access Memory (RAM), and a built-in Arithmetic-Logic Unit (ALU). Because of this configuration the controller 10 carries out multifunctional activities, apart from voice synthesizing, consisting of key input control, operation control, and display control.

Figure 4:
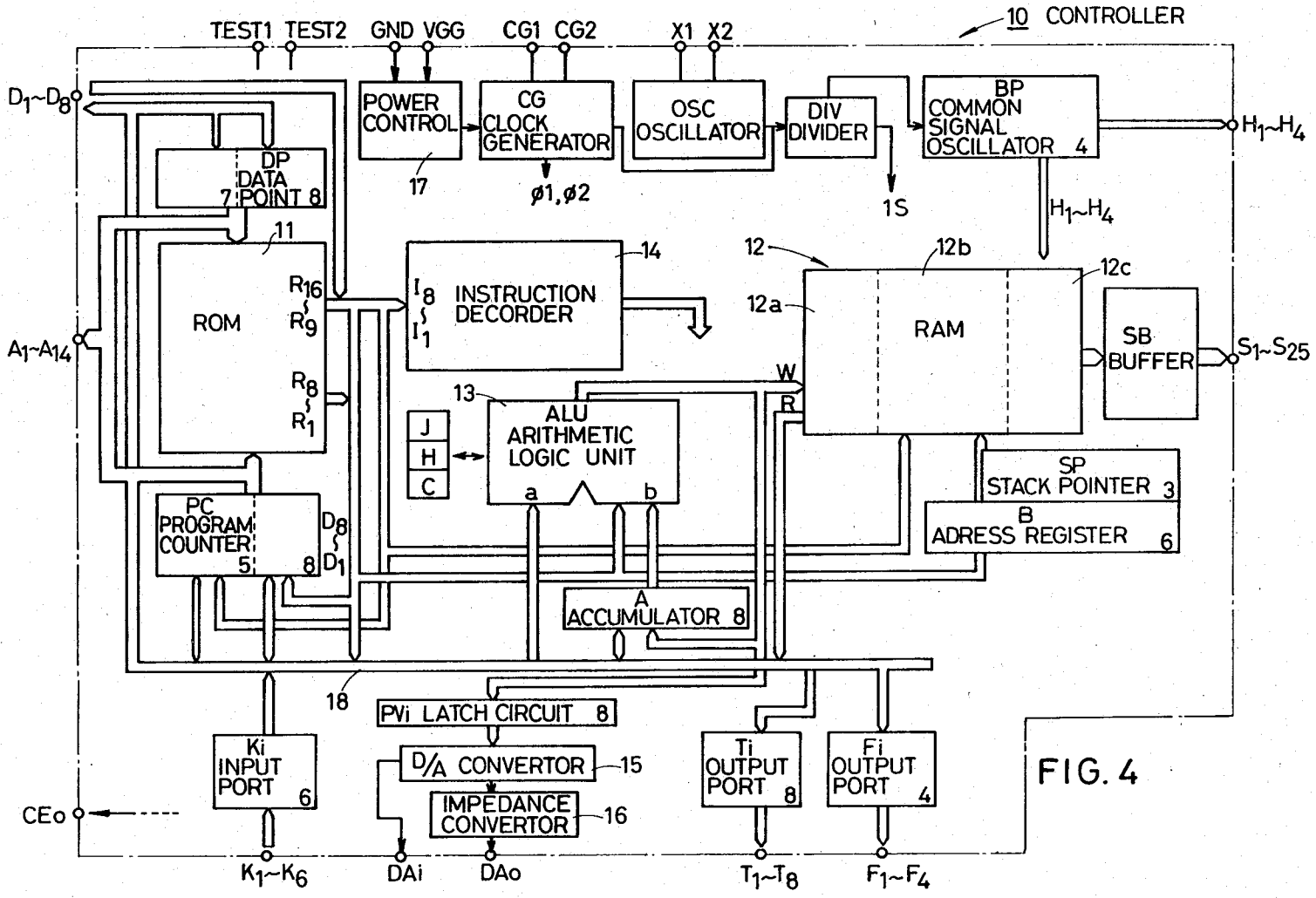
FIG. 4 is a block diagram showing the details of the configuration of one system embodiment.

FIG. 4 is a detailed drawing of the system configuration of the controller 10. The ROM 11 contains the previously stored voice synthesizing control program, the voice data program, and additional control programs (main program or program for operating the electronic calculator). Address signal terminals, $A_1$ to $A_4$, are used to connect to external memory, while $D_1$ to $D_8$ are data signal terminals. A program counter PC indicates the addresses of the voice synthesizing control program or other control programs stord in the ROM 11. A data pointer DP indicates the address of the voice data. The RAM 12 contains 64×8 bit bytes, or 512 bits. In the RAM 12 there is previously allotted an area 12*a* used for voice synthesis control, an area 12*b* used for the electronic calculator operation, and an area 12*c* used in connection with the display function. Each bit of the area 12*c* used in connection with the display function is connected with a corresponding segment in the liquid crystal display apparatus 50, and a pattern is displayed in the display apparatus according to the pattern programmed into the area 12*c*. In addition, when control and operation functions are being activated in the areas 12*a* and 12*b*, registers and flags are used. A register B is the address register for the RAM 12, and a stack pointer Sp is used in connection with a sub-routine stack in an area of RAM 12, and at that time it indicates the position of the address.

Operations of the Arithmetic Logic Unit 3 are carried out according to a signal from a data bus 18 or an output signal from the ROM 11 or a signal output from an accumulator A. In addition, there is a discriminating flip-flop J, a carrier flip-flop H from a 4th bit (half carrier), and a carrier flip-flop C.

An instruction decoder decodes the upper 8 bits of of operating code of the output from the Rom 11, and outputs a micro order. A power controller 17 receives a control signal from an internal clock general CG, and at the same time as it controls the start/stop of the system clocks $\phi_1$ and $\phi_2$, it controls the ON/OFF switch of the display power supply. In other words, during operation, the system clocks $\phi_1$ and $\phi_2$ output a pulse and the entire system is activated. Also, the display is activated, depending on the display control section. Because this LSI is C-MOS construction, by controlling the stopping of the system clock the consumption of electric power can be kept low. Aminus power terminal VGG of this LSI conforms to the logical low level (L). In order to oscillate the internal clock generator CG, terminals $CG_1$ and $CG_2$ are connected to a resistance or a ceramic filter.

A frequency of 131 KHz is selected for this oscillation. An oscillator OSC is provided for the clock function, and this oscillating signal is divided by a frequency divider DIV. Terminals $X_1$ and $X_2$ are connected to a quartz oscillator. In addition the input section of the frequency divider DIV takes the form of a Programmable Logic Array (PLA), and in the manufacturing process, as the result of an appropriate design, the output of both the internal clock generator CG and the oscillator OSC are divided. When used for the clock function, a one second signal 1S is output from the final stage of the frequency divider DIV. A common signal generating circuit BP of the liquid crystal display apparatus outputs the display area address of the RAM, and terminals $H_1 \sim H_4$ are the common signal output terminal. The display data from the display memory location 12*c* is temporarily stored in the buffer SB, and the liquid crystal display apparatus 50 receives segment signals as a high level of energy. Terminals $S_1$ to $S_{25}$ are connected to the segment terminals of the liquid crystal display apparatus. The terminals $K_1$ to $k_6$ of a six bit input port $K_i$ are connected to a key input apparatus 40, and the key return signal is entered. Terminals $T_1$ to $T_8$ of an 8 bit output port $T_i$ are attached to the key input apparatus, and the key strobe signal is output. In this embodiment of the present invention, the signal from the top position bit of the address signal from terminal $F_4$ of a four bit output port $F_i$ is sent to an exterior ROM.

A latch circuit PVi latches the 8-bit voice data output from the ALU 13. A terminal DAi puts out an analogue converted voice signal as output from a D/A converter 15. An impedance conversion circuit 16 from a feedback resistance connected between terminals DAi and DAo can operate a speaker by connecting to a simple amplifier circuit on the exterior. A terminal CEo outputs a chip enable signal to an exterior ROM. Without any explanatory diagram, the chip enable signal generating circuit is activated in micro order.

Terminals TEST1 and TEST2 are used to test the LSI. In addition, in the blocks throughout the diagrams the small numbers which are shown are the bit numbers.. Throughout FIG. 4 for one terminal multiple signal names are indicated by means of a "~" mark, but for a single terminal this is a representative explanation. For example, where $K_1 \sim K_6$ is shown, this really means that for signals $K_1$, $K_2$, $K_3$, $K_4$, $K_5$, $K_6$ there are six terminals (the signal names are the same as the terminal names).

Next we will give a brief explanation of the operation.

Figure 5:
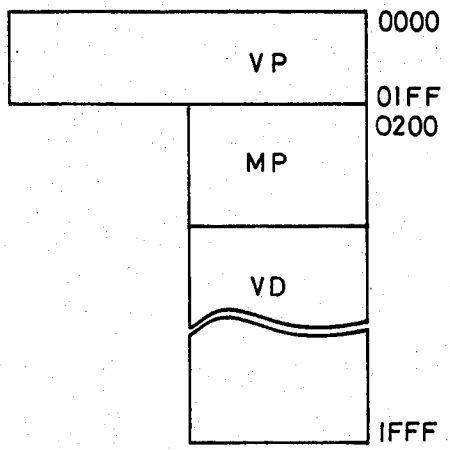
FIG. 5 is an outline diagram of a ROM memory map.

FIG. 5 shows an outline of the address of the ROM 11. The ROM 11 contains 8K bytes. The voice synthesis control program uses 16 bitts long steps, and the area VP occupies addresses from 0000 to 01FF. Apart from that, all other steps are 8-bits in length. The area from 0200 to 1FFF contains the main program for the electronic calculator function which is stored in the area MP, and the memory storage for voice data is area VD, the area being divided into two sections for use. The previously discussed program counter PC points out the addresses for VP and MP program areas, and the data pointer DP, depending on circumstances, points out the addresses in area MP. In short, when data is output from the ROM 11, the data pointer DP address information is set for the data which is supposed to be withdrawn, and the contents of the ROM 11 are taken out. In addition, at the time when the program instructions for the voice synthesizing control, or the main program instructions are activated, from the program counter PC, the execution of each instruction for the designated step increments the value of the program counter, and each step is executed in turn. Because one step of the voice synthesizing control program is 16 bits long it is a comparatively slow system clock, but it is possible to put into effect a voice synthesis requiring high speed operation. The 8 bits in the upper location are the operation code, and they are output by an instruction decoder as shown in FIG. 4, and the lower 8-bit position is output by the internal data bus 18.

In the case where an external ROM is provided, the instructions read out from that external ROM are input into the internal data bus and input into the instruction decoder. Also, the data is input into the internal data bus.

Figure 7:
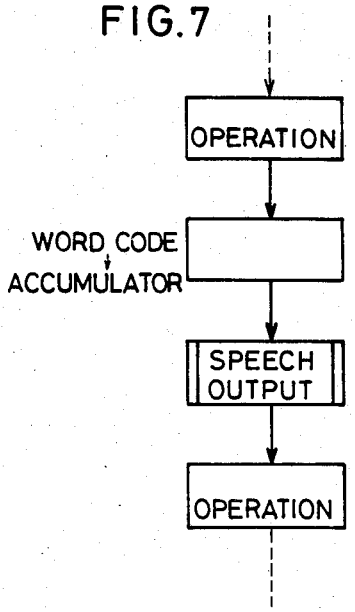
FIG. 7 is a diagram explaining the steps in handling.
Figure 6:
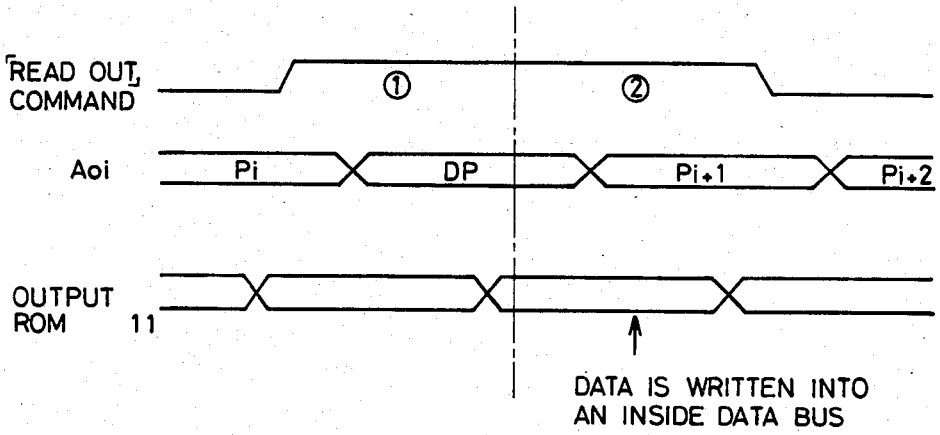
FIG. 6 is a diagram showing a timing chart.

FIG. 6 shows the time chart for instructions for retrieving data from the ROM 11 (voice data). These instructions are 2 cycle instructions, and the case shown is where the instructions in the step Pi are contained in the program counter PC. During the first cycle (1) the data location address is stored in the data counter DP, and on the second cycle (2) voice data is output to the internal data bus. After this the program counter PC is incremented. FIG. 7 shows an outline of the handling process for the whole apparatus. That is to say, the display of the distinct keys, the operation, and the results of the operation are executed by the operation of the main program in the ROM 11. In the case where voice information is acted upon, a word code conforming to a previously selected word is loaded into the accumulator A, and from a jump (subroutine call) to the voice synthesizing control program the voice data of that word is acted upon.

Next, we will explain the preferred method of achieving the objectives of the present invention. An impedance converting circuit 16 is built into the output section of the D/A converter 15, and the terminal DAo is taken out of the impedance converter circuit 16. As a result of this, the circuit around the speaker 30, especially the voice amplifier circuit, can be simplified and made more compact.

Figure 9:
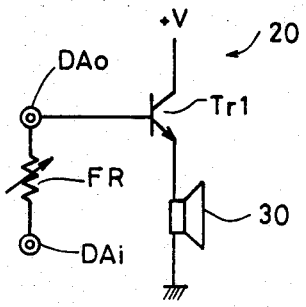
FIG. 9 is a diagram showing one example of the connection configuration of an external circuit.
Figure 8:
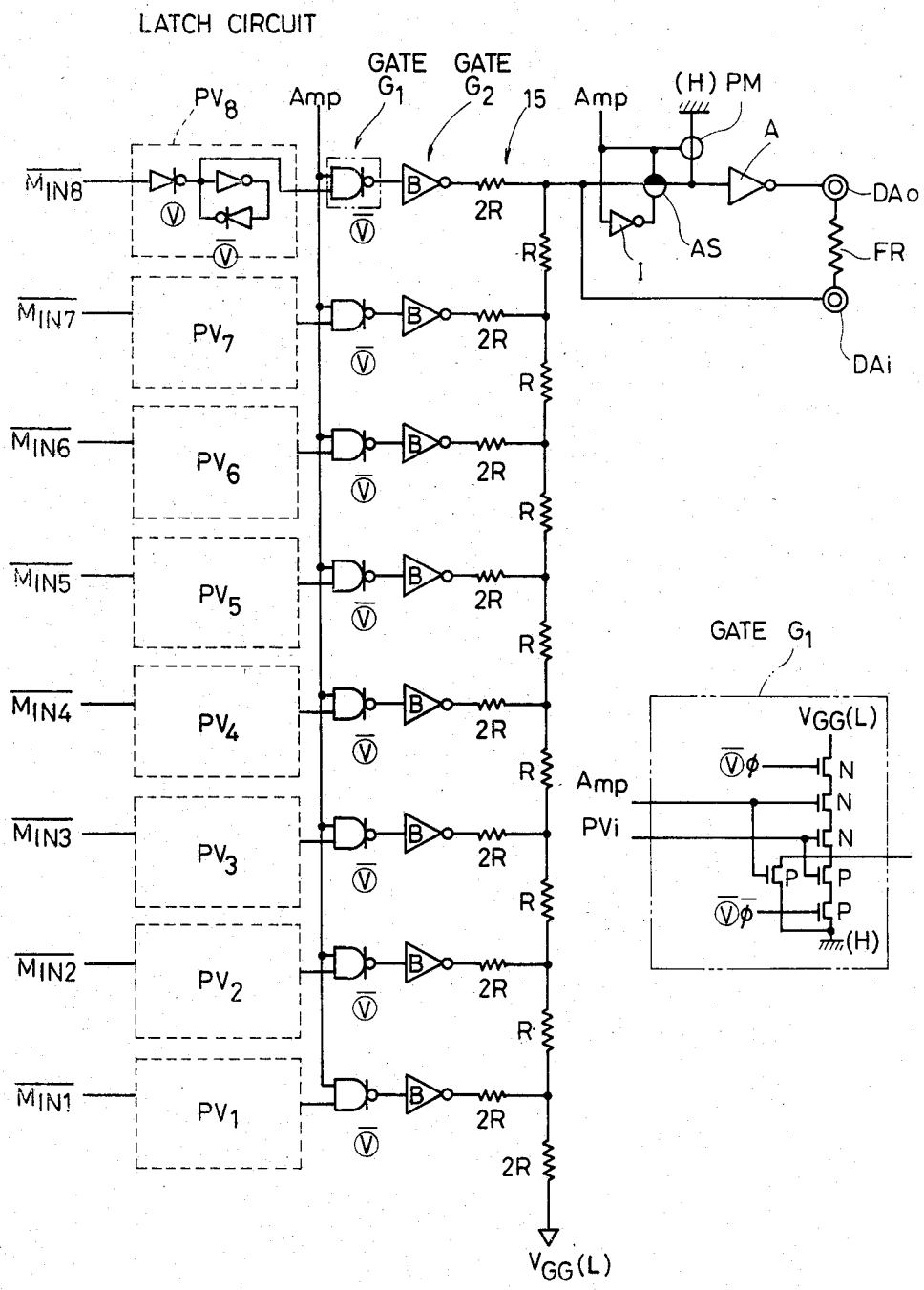
FIG. 8 is a detailed circuit diagram of the synthesized sound output of one embodiment of the present invention.

FIG. 8 is a detailed circuit diagram of that section. In the diagram, the output section of latch circuits $PV_1$ to $PV_8$ for digital voice signals, through gates $G_1$ and $G_2$ are connected to the D/A converter 15 from a ladder resistance circuit network. This ladder resistance circuit network is formed from a diffused resistor, for high accuracy. The output DAi from the D/A converter 15 is taken externally from the terminal. At the same time, the inverter circuit A of the impedance converter circuit 16 is set up in the output of the D/A converter 15. Then the output from the inverter A is taken from the terminal to the outside section. In other words, by connecting the feedback resistance FR between the input and output of inverter circuit A, that is, between the terminal DAo and the terminal DAo, the inverter circuit A is used as a linear amplifier. Because the resistance R of the ladder resistance circuit network is some 10K ohms, the output impedance of the D/A converter circuit 15 is rather high. From this, the output impedance from the inverter circuit A, as an impedance converter circuits, is made low. Therefore the current can be taken externally, and as shown in FIG. 9, the speaker 30 can be operated with an emitter-follower circuit with only one transistor Tr1. Furthermore, in the circuit shown in FIG. 9, the feedback resistance FR is shown as a variable resistance, but this is in consideration of the variance in the characteristics of the LSI.

Next, we will discuss electrical energy saving counter-measures for the LSI. A NAND gate $G_1$ provided in the input of the D/A converter circuit 15 is controlled from the Amp signal (details of the gate G1 are given in a separate diagram to the lower right hand side of (FIG. 8). This amp signal is obtained from the logic $F_1 \cdot (\overline{ACL+ST})$. The signal $F_1$, the same as for the previously discussed amplifier, is the signal for power ON (the output from the port $F_1$), the signal ACL shows the auto-clear condition, and the signal ST shows the conditions in the display panel. In short, when voice output conditions exist, and auto-clear conditions do not exist, the NAND gate operates as a clocked gate, and the contents of latch PVi are D/A converted. In another case, because the output of the NAND gate $G_1$ becomes "H", the input of the D/A conversion circuit becomes "L". Because of this, current does not flow in the ladder resistance circuit network, and there is no waste of electric power.

On the other hand, control is effected by this Amp signal in the impedance conversion circuit also. This control circuit is comprised of an inverter I, an analogue switch AS, and a MOS gate PM. If this control circuit were absent, when the input to the inverter circuit A became "L", because the output became "H", current would pass through the feedback resistance FR, and when there was no voice output electric power would be wasted. With the control circuit supplied, when the Amp signal is "L", the analogue switch AS is in the OFF position, and the input to the inverter circuit becomes "H". When the terminal DAo becomes "L", no current flows in the feedback circuit FR. In addition, in the case of a voice amplifier circuit connected as shown in FIG. 9, transistor $T_{r1}$ goes to the OFF position, and there is no wasted current flowing in the speaker 30. In this way, the electric power reduction in the control circuit is large.

Furthermore, as stated, this embodiment of the present invention, among the many methods of voice synthesizing, does not require hardware such as a sound generating circuit and digital filter, and it is an especially effective wave form synthesizing method (sine wave weighted method).

The invention being thus described, it will be obvious that the same may be varied in many ways. Such variations are not to be regarded as a departure from the spirit and scope of the invention, and all such modifications are intended to be included within the scope of the following claims.

What is claimed is:

1. An electronic apparatus for performing a primary function and a synthesized sound generating function, said apparatus comprising:

a single chip integrated circuit including;

input control means for controlling input data developed externally of said single chip integrated circuit;

calculation control means, operatively connected to said input control means, for handling said input data and for performing said primary function and said synthesized sound generation function;

a single read only memory storing and providing to said calculation control means a primary control program for controlling said primary function, a synthesis control program for controlling said synthesized sound generating function and sound data used by said calculation control means to synthesize desired sounds;

random access memory means for storing and providing to said calculation control means data used by said calculation control means in performing said primary function and said synthesized sound generation function; and main program counter means, responsive to control by said calculation control means, for addressing locations in said read only memory containing said primary control program and synthesis control program to provide said programs to said calculation control means; and data counter means, responsive to control by said calculation control means, for addressing locations in said read only memory containing said sound data to provide said sound data to said calculation control means.

2. The electronic apparatus of claim 1 wherein said single chip integrated circuit further comprises D/A converter means for converting said sound data received from said calculator control means into an analog waveform; and impedance converter means for developing an output from said single chip integrated circuit from said analog waveform.

3. The apparatus of claim 2 wherein said impedance converter means comprises an inverter circuit.

4. The apparatus of claim 1 wherein an impedance circuit is connected between the input and output of a feedback resistance.

* * * * *